US005517103A

United States Patent [19]

Ng et al.

[11] Patent Number: 5,517,103

[45] Date of Patent: May 14, 1996

[54] REFERENCE CURRENT SOURCE FOR LOW SUPPLY VOLTAGE OPERATION

[75] Inventors: Solomon K. Ng; Gee H. Loh, both of Singapore, Singapore

[73] Assignee: SGS Microelectronics, PTE Ltd., Singapore

[21] Appl. No.: 105,450

[22] Filed: Aug. 12, 1993

[30] Foreign Application Priority Data

Nov. 6, 1992 [GB] United Kingdom ..... 9223338

[51] Int. Cl.[6] ..... G05F 3/20

[52] U.S. Cl. ..... 323/315; 323/901; 323/907; 323/312

[58] Field of Search ..... 323/312, 313, 323/315, 281, 901, 907

[56] References Cited

U.S. PATENT DOCUMENTS

| | | | |
|---|---|---|---|
| 4,119,924 | 10/1978 | Ahmed | 330/288 |
| 4,260,945 | 4/1981 | Ahmed | 323/316 |
| 4,412,186 | 10/1983 | Nagano | 330/288 |
| 4,558,272 | 12/1985 | Grosch | 323/315 |
| 4,879,524 | 11/1989 | Bell | 330/288 |
| 5,293,112 | 3/1994 | Takahashi | 323/315 |
| 5,349,286 | 9/1994 | Marshall et al. | 323/315 |

FOREIGN PATENT DOCUMENTS 2212633 7/1989 United Kingdom .

*Primary Examiner*—Peter S. Wong
*Assistant Examiner*—Adolf Berhane
*Attorney, Agent, or Firm*—Robert Groover; Betty Formby

[57] ABSTRACT

A circuit for providing a reference current comprises first and second matched transistors, each of which has a control node and a controllable path and each of which is connected so that a current setting resistor is in the controllable path of the second matched transistor, the current setting resistor having a value, current set in the controllable path of the second matched transistor is related to a difference in voltage characteristics between the first and second matched transistors and to the value of the current setting resistor, and third and fourth matched transistors, each of the third and fourth matched transistors having a controllable path connected respectively to the controllable paths of the first and second matched transistors, and control electrodes of the third and fourth matched transistors connected together; a set of output transistors connected to the circuit to supply the reference current in dependence on a set current; and a fifth transistor having a controllable path between a bias node related to a first supply voltage level and a node set at one voltage characteristic relative to a second supply voltage level so as to maintain a voltage across one of the third and fourth matched transistors at a value which is independent of the first supply voltage level to reduce a magnitude of changes in the reference current as a function of the first supply voltage, the fifth transistor having a control electrode connected to the conductive path of the first matched transistor.

34 Claims, 6 Drawing Sheets

REFERENCE CURRENT SOURCE FOR LOW SUPPLY VOLTAGE OPERATION

CROSS REFERENCE TO RELATED APPLICATIONS

This application claims priority from British application 922338.6, filed Nov. 6, 1992.

BACKGROUND AND SUMMARY OF THE INVENTION

This invention relates to a low voltage reference current generating circuit, capable of providing either a current source or current sink of a reference current which is defined by a current setting resistor.

Current generating circuits are well known in the art and in their simplest form consist of a pair of matched current mirror transistors, each having a controllable path and a control node for controlling conduction of the controllable path. In bipolar technology, the control node is the base and the controllable path is from collector to emitter. In MOS technology, the control node is the gate and the controllable path is the source/drain channel. The present invention is concerned particularly but not exclusively with bipolar technology. One of the transistors has a current setting resistor connected in its controllable path and the other transistor has its control node connected to the control node of the one transistor and also into its own controllable path. When a current flows through the current setting resistor, the same current is caused to flow in the controllable path of the other transistor and can be used to drive a suitable output transistor to sink or source a reference current related to that current through the area ratio of the output transistor and the current mirror transistors. In practical terms, the basic current mirror circuit has many limitations. One of these is that its impedance is too low for it to act as a perfect current source or sink when connected to other circuitry. To increase the impedance, it is common to include a pair of matched cascode transistors connected respectively to the current mirror transistors. Such a circuit is shown in FIG. 1*a*.

In FIG. 1*a*, references Q3 and Q4 denote a first set of matched transistors. Their bases are connected together at the connection point denoted as node 41. In addition, the base of the transistor Q3 is connected to its collector. Reference numerals Q5 and Q6 denote a second set of matched transistors. The transistor Q5 has its collector connected to the emitter of transistor Q3 and its emitter connected to ground. Its base is connected to its own collector at node 42 and to the base of transistor Q6. The transistor Q6 has its collector connected to the emitter of transistor Q4 at node 43 and its emitter connected via a current setting resistor R to ground. Reference numerals Q8 and Q7 denote output transistors connected in cascode for sinking the reference current Ir. Each output transistor has its base connected to receive the base current being injected into the transistor of the associated set (Q8 for Q3 and Q7 for Q5). The circuit is such that the reference current Ir is intended to match a current I flowing through the current setting resistor R.

Reference numerals Q1 and Q2 denote bias transistors which have their bases connected together and their emitters connected to the supply voltage Vdd. In addition, the base of the transistor Q2 is connected to its collector. The collectors of bias transistors Q1 and Q2 are connected respectively to the collectors of the first matched transistors Q3 and Q4, the latter connection being denoted as node 44.

Other known current generating circuits are illustrated for example in EP-A-155720 in the name of Philips which illustrates a cascode current source arrangement having a current mirror circuit with two current paths comprising transistors and resistors. Reference is also made to DE-C-3335379 which describes an integrated low voltage constant current source with a transistor for amplifying differential current and controlling a pair of bias transistors.

The present invention seeks to provide particularly a current source or current sink circuit which can operate down to a relatively low voltage (down to about 1.4 volts) and which has a high DC PSRR (power supply rejection ratio). The DC PSRR is defined as the ratio of the change in current source/sink reference current to the change in DC power supply.

According to the present invention there is provided a circuit for providing a reference current comprising:

first and second matched transistors each having a control node and a controllable path and connected so that with a current setting resistor in the controllable path of the second transistor, the current set in that controllable path is related to the difference in voltage characteristics between the first and second transistors and to the value of the current setting resistor;

third and fourth matched transistors each having a controllable path connected respectively to the controllable paths of the first and second transistors and their control electrodes connected together;

a set of output transistors connected in the circuit to be driven to supply said reference current in dependence on the set current; and a fifth transistor connected in the circuit with its controllable path between a bias node related to a first supply voltage level and a node set at one voltage characteristic relative to a second supply voltage level so as to maintain the voltage across one of the third and fourth transistors at a value which is independent of the first supply voltage level thereby to reduce the magnitude of changes in the reference current as a function of the first supply voltage.

In a first embodiment the transistors are bipolar n-p-n transistors; the first supply voltage level is a positive value Vdd and the second supply voltage level is ground. The bases of the first and second transistors are connected together and the base of the first transistor is connected to its collector. The emitters of the third and fourth transistors are connected respectively to the collectors of the first and second transistors and the collector and base of the fourth transistor are connected together. With this arrangement, the base of the fifth transistor is connected to the collector of the third transistor so as to maintain the collector emitter voltage of the third transistor at a value which is independent of the supply voltage. The collector of the fifth transistor is connected to the bias node of the circuit and the emitter of the fifth transistor is connected to the bases of the first and second transistors, which are at a voltage level of one base-emitter voltage Vbe above the second supply voltage level (ground). The collector emitter voltage of the third transistor is thus held at 2 Vbe above ground and this reduces the so-called "early effect", described later.

In a second embodiment, the base of the first transistor is connected to the collector of the second transistor while the base of the second transistor is connected to the collector of the first transistor so that the first and second transistors are cross-coupled. In this embodiment, the emitter of the fifth transistor is connected to the base of the first transistor. Also, the collector of the fourth transistor is connected to its base.

In these arrangements, the early effect of the collector-emitter voltage of the fourth transistor is reduced since its collector is now connected to a point which is held at 2 Vbe above ground (Vbe of the first transistor and Vbe of the third transistor).

In the described embodiment, the bias node for the fifth transistor is provided by two bias transistors each being of opposite type to the first to fifth transistors i.e. p-n-p where the first to fifth transistors are n-p-n and having their emitters connected to the first supply voltage level and their collectors connected respectively to the collectors of the third and fourth transistors. The bases of the bias transistors are connected together to provide the bias node for the fifth transistor.

It will be appreciated that the term "matched transistors" used herein denotes transistors whose collector currents are substantially the same in the same conditions.

BRIEF DESCRIPTION OF THE DRAWING

For a better understanding of the present invention, and to show how the same may be carried into effect reference will now be made by way of example to the accompanying drawings, in which.

DESCRIPTION OF THE PREFERRED EMBODIMENTS

Figure 1A:
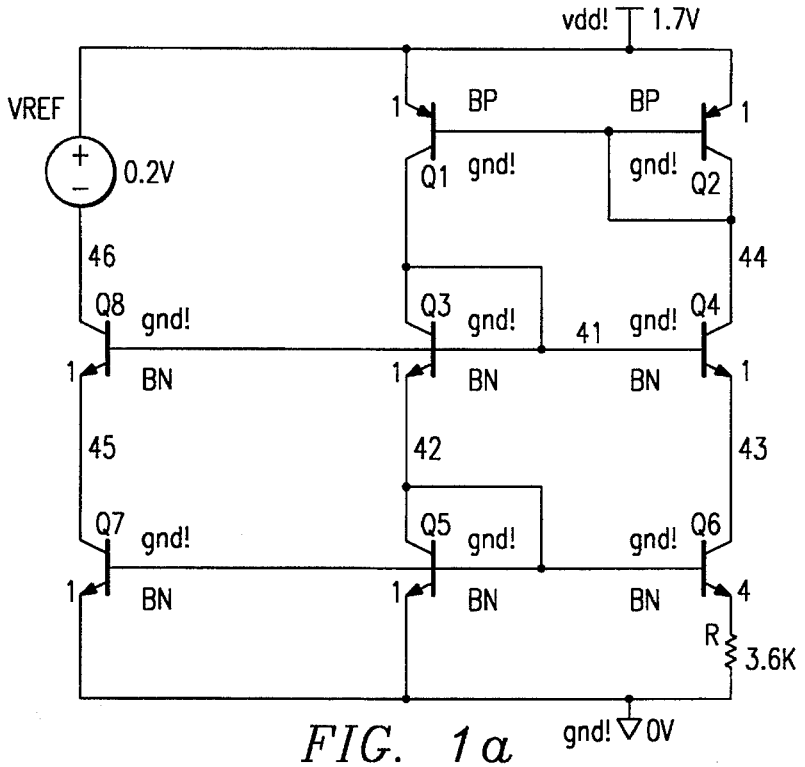
FIG. 1a (PRIOR ART)
FIG. 1*a* is a circuit diagram of a known current source.
Figure 5:
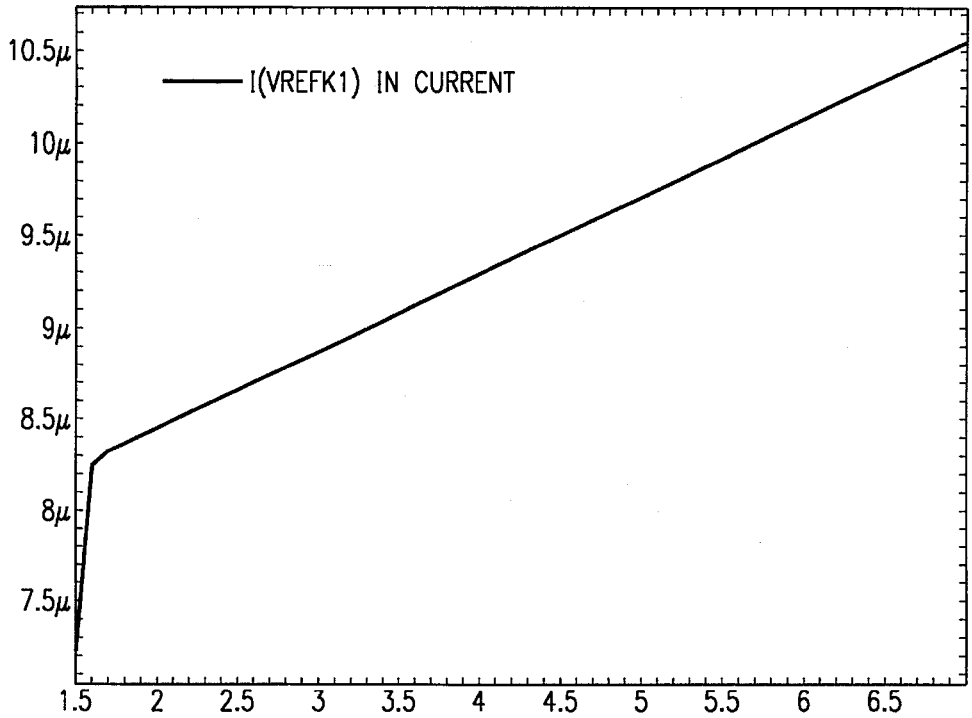
FIG. 5 (PRIOR ART)
FIG. 5 is a graph similar to that of FIG. 3 for the circuit of FIG. 1*a;*

FIG. 1*a* shows a conventional current mirror circuit which has already been described above with reference to the prior art. FIG. 5 is a graph which shows the variation in reference current with power supply for such a circuit. As can be seen from FIG. 5, the DC PSRR at 10 μA nominal reference current is $$\frac{10.564\ \mu A - 8.344\ \mu A}{7V - 1.7V} = 418\ nA/V.$$

Figure 1B:
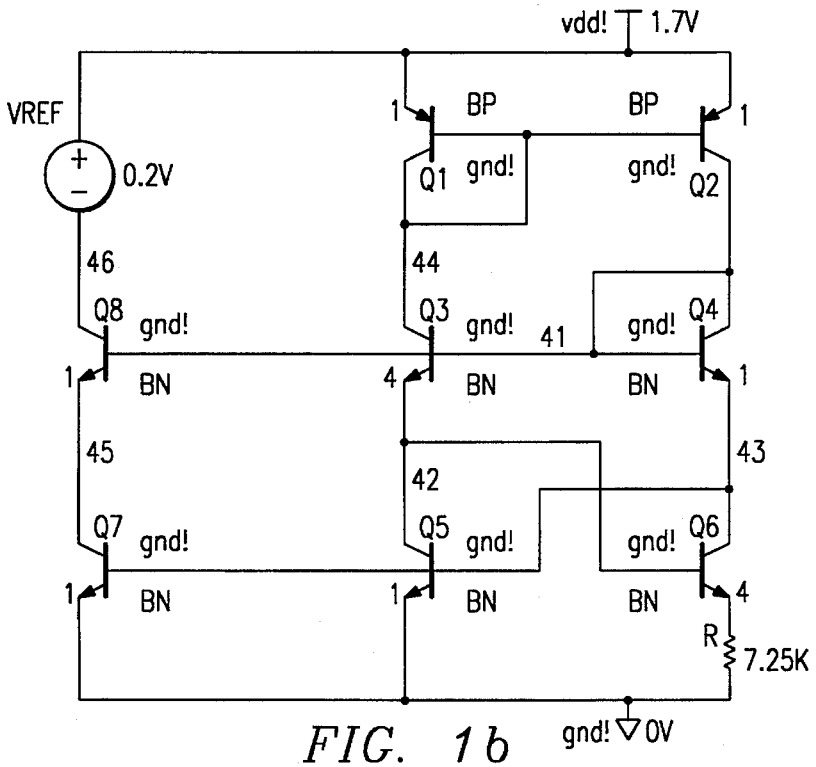
FIG. 1b (PRIOR ART)
FIG. 1*b* is a circuit diagram of the current source of FIG. 1*a* modified by having cross-coupled current source transistors.

FIG. 1*b* is a circuit diagram of a circuit which is similar to that of FIG. 1*a* except that the first and second transistors are cross-coupled. That is, the base of the transistor Q5 is connected to the collector of the transistor Q6 and the base of the transistor Q6 is connected to the collector of transistor Q5. With this arrangement, the voltages at nodes 42 and 43 are fixed at 1 Vbe above ground, where Vbe is the normal base emitter voltage of a bipolar transistor, typically 0.7 V. The cross coupling of the transistors Q5, Q6 also minimises the mismatch between the reference current Ir and the set current I as will be described in more detail hereinafter.

The following discussion analyzes the circuit of FIG. 1*b*. The collector emitter voltage across the current mirror transistor Q3, VceQ3 is equal to the supply voltage Vdd less the voltage drops in the path through Q1, Q6 and the current setting resistor R. That is, the collector emitter voltage across the transistor Q3 is given by the following equation:

$$VceQ3 = Vdd - VbeQ1 - VbeQ6 - IR \qquad \text{Eqn. 1}$$

where I is the current flowing through the resistor R; and VbeQ1 and VbeQ6 in each case designates the base emitter voltage of the respective transistors Q1 and Q6.

VbeQ1 is normally equal to 1Vbe drop, that is normally 0.7 V. Due to the cross coupling arrangement of the transistors Q5, Q6, closed loop analysis gives VbeQ5=VbeQ6+IR. Taking VbeQ5=–0.7 V, then $$VceQ3 = Vdd - 0.7 - 0.7 = Vdd - 1.4. \qquad \text{Eqn. 1}a$$

Figure 10:
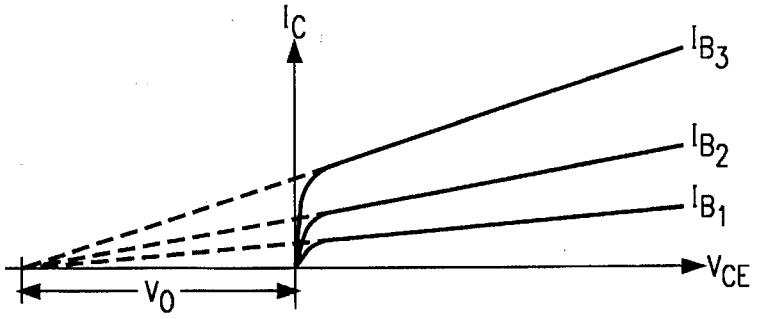
FIG. 10 shows the usual I–V characteristics of a bipolar transistor.

Consider now FIG. 10 which shows the normal I–V characteristic of a bipolar transistor. That is, FIG. 10 shows the variation of collector current Ic with the collector emitter voltage Vce for three different values of base current IB1, IB2 and IB3.

By extrapolating backwards the linear portions of the curve, they are seen to meet at a point on the voltage axis at a value Va which is called the early voltage, where $$Va = \frac{Ic}{dIc/dVce}$$

and a typical value for Va is 50 to 100 V.

The variation of Ic with Vce is called the early effect. The influence of the early effect can be expressed by the following equation:

$$Ic = Is\left(1 + \frac{Vce}{Va}\right)\exp\left\{\frac{Vbe}{V_T}\right\} \qquad \text{Eqn. 2}$$

where Ic is the collector current, Is is the saturation current, Vce is the collector emitter voltage, Va is the early voltage, Vbe is the base emitter voltage and $V_T$ is the thermal voltage.

For normal design work, the equation is normally shortened to its first order form of $$Ic = Is\exp\left\{\frac{Vbe}{Vc}\right\}.$$

However, the present inventors have now discovered that the term $$1 + \frac{Vce}{Va}$$

which qualifies Is can have an adverse effect.

Inserting the results of the analysis of the circuit of FIG. 1*b* into Equation 2 gives a value for the collector current of Q3, IcQ3 as follows:

$$IcQ3 = Is\left(1 + \left\{\frac{Vdd - 1.4}{Va}\right\}\right)\exp\left\{\frac{Vbe}{V_T}\right\}$$

Thus, in practice the current flowing through Q3 and thus the current through Q5 and the output transistors Q7 and Q8 is modulated by the collector emitter voltage of the transistor Q3 which is, through Eqn. 1*a*, very much related to the supply voltage Vdd.

Figure 6:
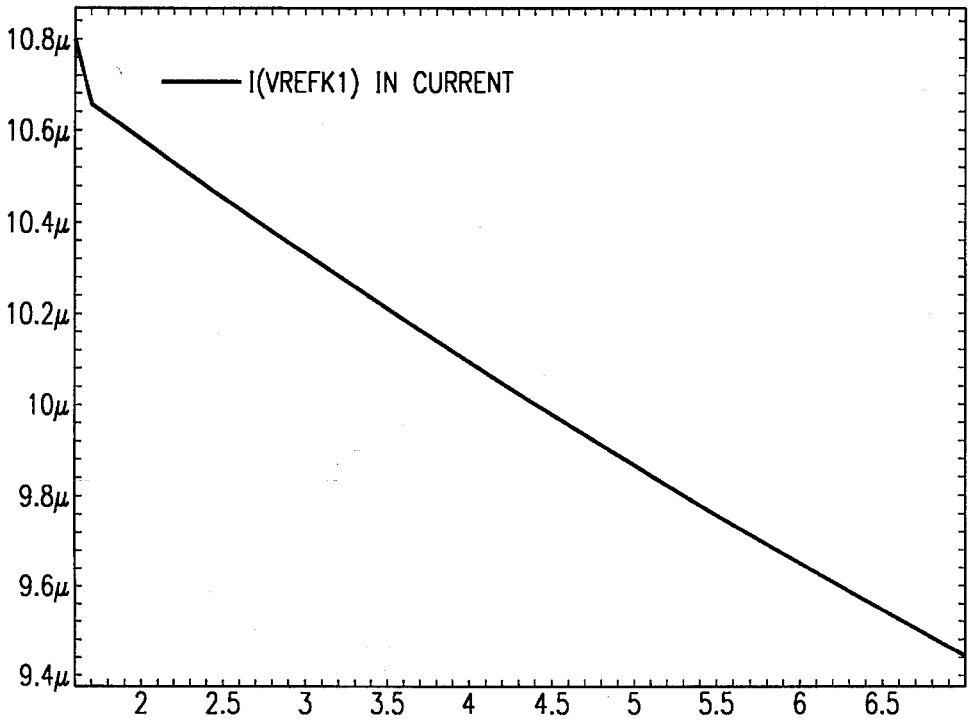
FIG. 6 (PRIOR ART)
FIG. 6 is a graph similar to that of FIG. 3 for the circuit of FIG. 1*b;*

FIG. 6 shows the variation of the reference current with power supply for the circuit of FIG. 1*b*. As can be seen from FIG. 6, the DC PSRR at 10 μA nominal is $$\frac{9.445\ \mu A - 10.653\ \mu A}{7V - 1.7V} = 228\ nA/V.$$

Thus, although there is an improvement over the circuit of FIG. 1*a*, the DC PSRR is still of an unacceptable order of magnitude.

Figure 2:
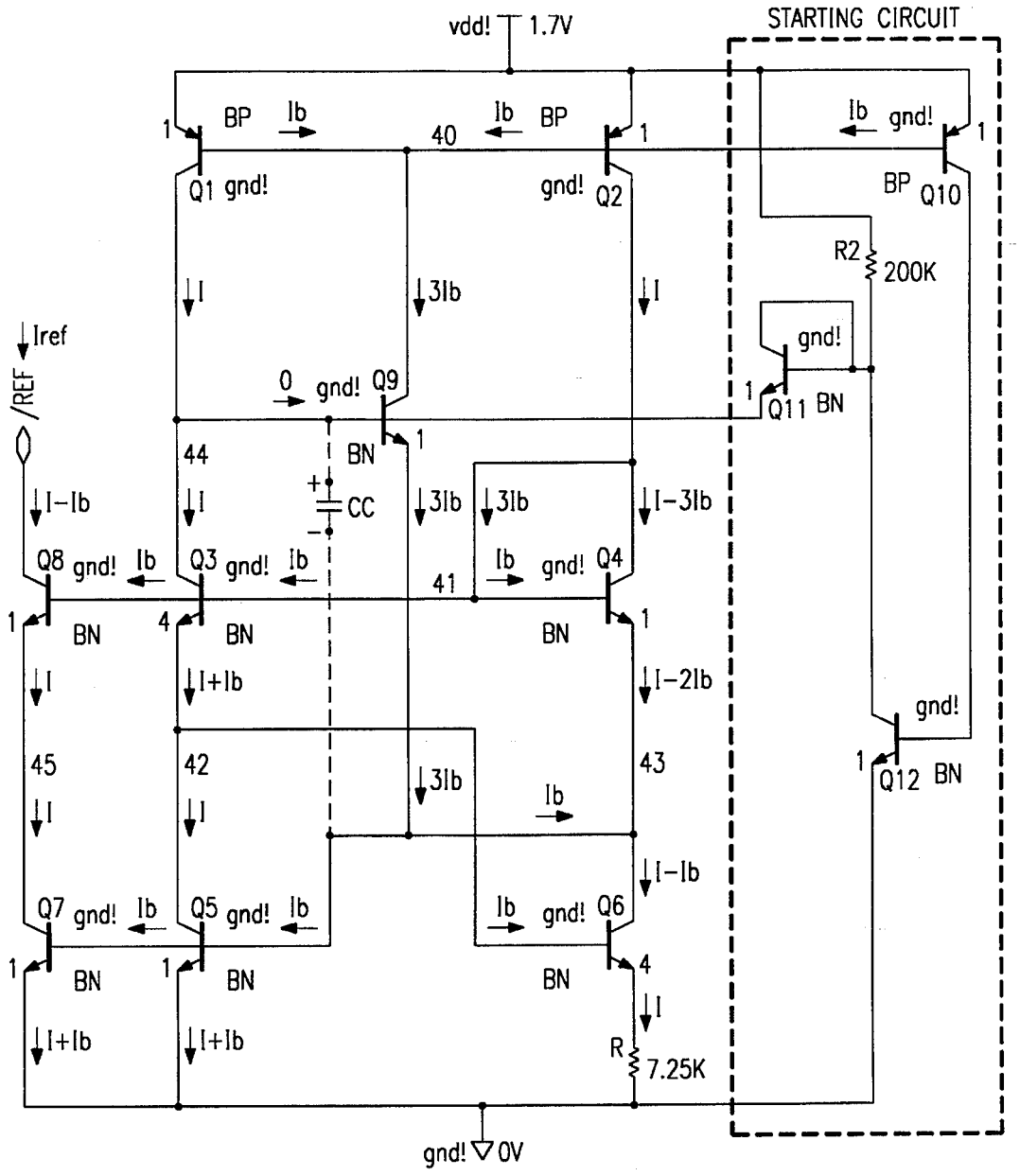
FIG. 2 is a circuit diagram of a preferred embodiment of the present invention, with a starting circuit and a capacitor for frequency compensation.

FIG. 2 shows a circuit according to a preferred embodiment of the present invention. In this circuit, like numerals designate like parts as in FIGS. 1*a* and 1*b*. That is, there is a first pair of matched transistors Q5, Q6, a second pair of cross coupled matched transistors Q3, Q4 and a set of two output transistors Q7, Q8. These are connected as described above with reference to FIG. 1*b*. The circuit also comprises bias transistors Q1, Q2 each having their emitter connected to a supply voltage Vdd and their collectors connected to respective collectors of the second pair of matched transistors Q3, Q4. In the circuit of FIG. 2 there is a further transistor Q9 having its base connected at node 44 to the collector of one of the second pair of transistors Q3 and having its own collector connected to the bias node 40 provided by the bias transistors Q1, Q2 where their bases are connected together. In the circuit of FIG. 2, the emitter of the transistor Q9 is connected at the junction of the base of one of the first pair of transistors Q5 and the collector of the other of the first pair of transistors Q6.

The addition of the transistor Q9 eliminates the so-called early effect by fixing the collector voltage of the transistor Q3 at node 44 to a value which is 2 Vbe above ground, VbeQ5+VbeQ9. This effectively fixes the collector emitter voltage of the transistor Q3 at 2 Vbe, and thus renders it independent of the supply voltage Vdd. Thus, the collector current of the transistor Q3 is now independent of variations in the supply voltage Vdd. Thus, as the collector current IceQ3 flows through the transistor Q5 and is reproduced at the output transistor Q7, it will remain independent of changes to the supply voltage Vdd. The reproduction at the output transistor Q7 will of course depend on the ratio of areas between Q7 and Q5, as described later.

The variation of the reference current Ir with the set current I can be seen from the following analysis of the current in the loop Q3, Q6 and R of FIG. 2.

In this loop, $$VbeQ3+VbeQ6+IR=VbeQ4+VbeQ5.$$

Thus, $$IR=VbeQ4+VbeQ5-(VbeQ3+VbeQ6).$$

As explained above $$I = Is\left\{1 + \frac{Vce}{Va}\right\}\exp\left\{\frac{Vbe}{V_T}\right\}.$$

VceQ6 is set at 1Vbe above ground (by Q5) and VceQ4 is set at 2Vbe above ground (by tying the collector of Q4 to its base and thus to the base of Q3). The fixing of Vce of Q3 by Q9 has been explained. Thus, the equation can be used in its shortened, supply voltage independent form. Also, the transistors are selected so that VbeQ4=VbeQ5 and VbeQ3=VbeQ6 while VbeQ5≠VbeQ6.

Therefore $$VbeQ4 + VbeQ5 = 2V_T\ln\left\{\frac{I}{I_{s1}}\right\}$$

and $$VbeQ3 + VbeQ6 = 2V_T\ln\left\{\frac{I}{I_{s2}}\right\}.$$

where Is1 and Is2 are the saturation currents of Q4 and Q3 respectively.

Thus, $$IR = 2V_T\ln\left\{\frac{I}{I_{s1}}\right\} - 2V_T\ln\left\{\frac{I}{I_{s2}}\right\} = 2V_T\ln\left\{\frac{IS2}{I_{s1}}\right\} = 2V_T\ln(A1)$$

where A1 is the area ratio between Q3 and Q4 or Q5 and Q6. In one example, A1=4. Thus, the reference current generation can be controlled by altering R or A1 depending on requirements.

The reference current output by the circuit follows the set current, in dependence on the area ratio between Q7 and Q5, A2. Namely, Ir=A2I. In the example described herein A2=1.

In practice, a simple current analysis of the circuit of FIG. 2 shows that the reference current differs from the load current I by a small value equivalent to the base current Ib of a transistor, typically 20 nA. Thus, although there is a mismatch between set and reference currents this is minimised by the cross coupling of the transistors Q5, Q6. This analysis is shown in FIG. 2 where current values are marked aside the collector emitter and base currents of each transistor.

In the circuit of FIG. 2, a starting circuit is shown indicated by a broken line defining block S. This starting circuit comprises a transistor Q10 having its emitter connected to the supply voltage Vdd, its base connected to the junction of the bases of the bias transistors Q1, Q2 and its collector connected to the base of a further transistor Q12. The further transistor Q12 has its emitter connected to ground and its collector connected via a resistor R2 to the supply voltage Vdd. A start up transistor Q11 has its base connected downstream of the resistor R2, its collector connected to its base and its emitter connected to drive the base of the further transistor Q9 of the current source circuit.

FIG. 2 also shows a capacitor CC for frequency stabilisation purposes between the base and emitter of the transistor Q9.

Figure 3:
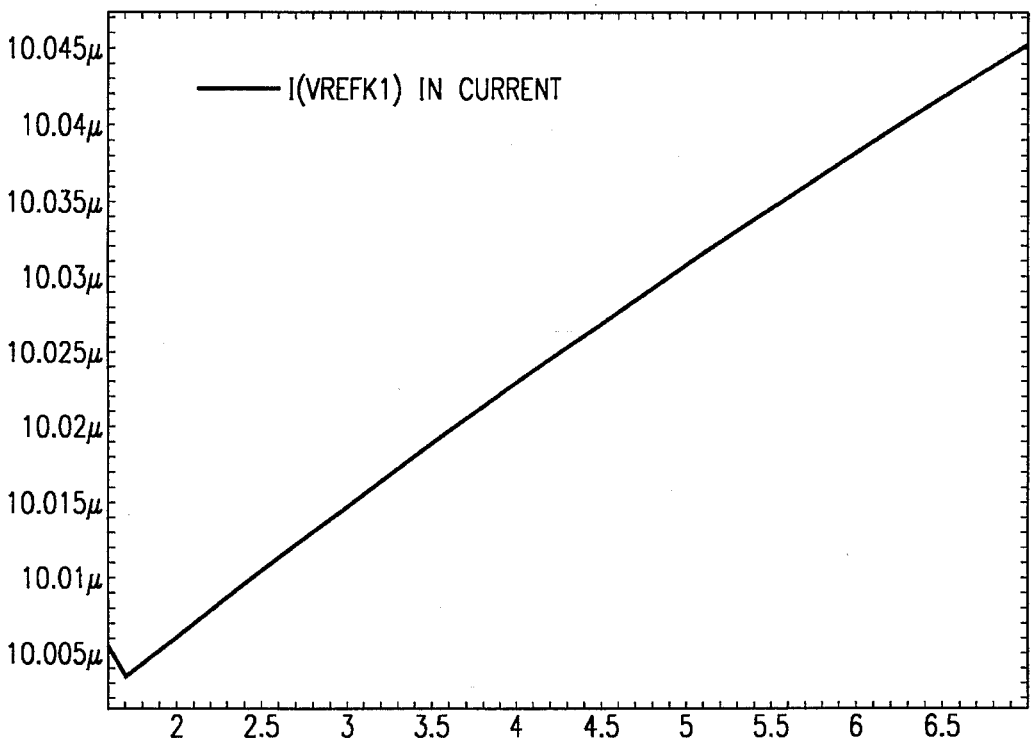
FIG. 3 is a graph of the change in reference current Ir with power supply voltage Vdd for the circuit of FIG. 2.

FIG. 3 is a graph showing the variation in reference current with supply voltage for the circuit of FIG. 2. As can be seen from FIG. 3, the DC PSRR at 10 μA nominal is $$\frac{10.045\ \mu A - 10.003\ \mu A}{7V - 1.7V} = 7.9\ nA/V.$$

This is a significant improvement over the equivalent values for the circuits of FIGS. 1*a* and 1*b*.

Figure 4:
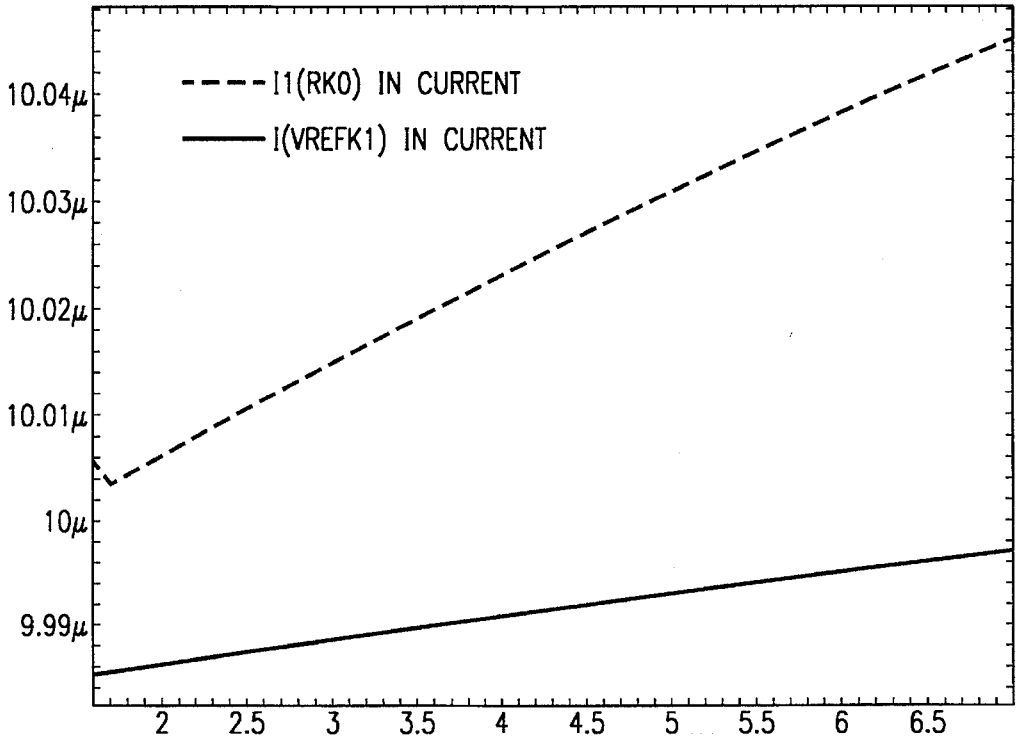
FIG. 4 is a graph of the mismatch between the set current I and the reference current Ir in the circuit of FIG. 2.

FIG. 4 shows the current mismatch between the load current I and the reference current Iref as being 20 nA at 2 V supply.

Figure 7:
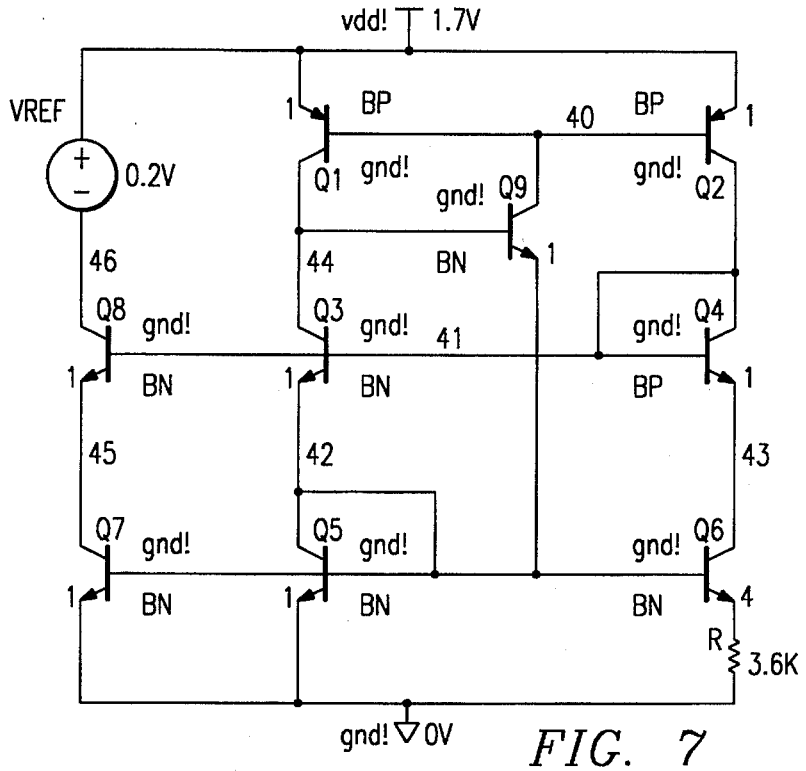
FIG. 7 is a circuit diagram of an embodiment of the invention in which the cascode transistors are not cross-coupled.
Figure 8:
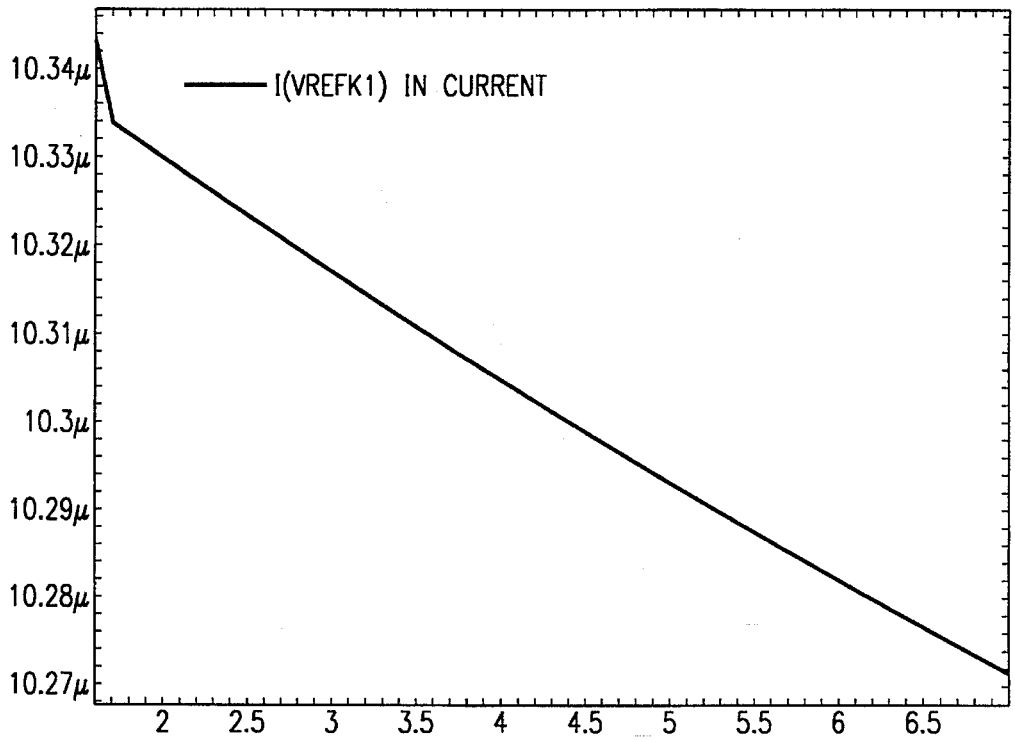
FIG. 8 is a graph similar to that of FIG. 3 for the circuit of FIG. 7.

FIG. 7 is a diagram of a circuit according to another embodiment of the present invention which is the same as that of FIG. 2 except that the start up circuit is not illustrated and except that the transistors Q5 and Q6 are not cross-coupled but instead are arranged as in the prior art circuit of FIG. 1*a*. This circuit nevertheless represents a significant improvement in the DC PSRR as illustrated by FIG. 8 from which it can be seen that the DC PSRR is $$\frac{10.272\ \mu A - 10.334\ \mu A}{7V - 1.7V} = -11.7\ nA/V.$$

Figure 9A:
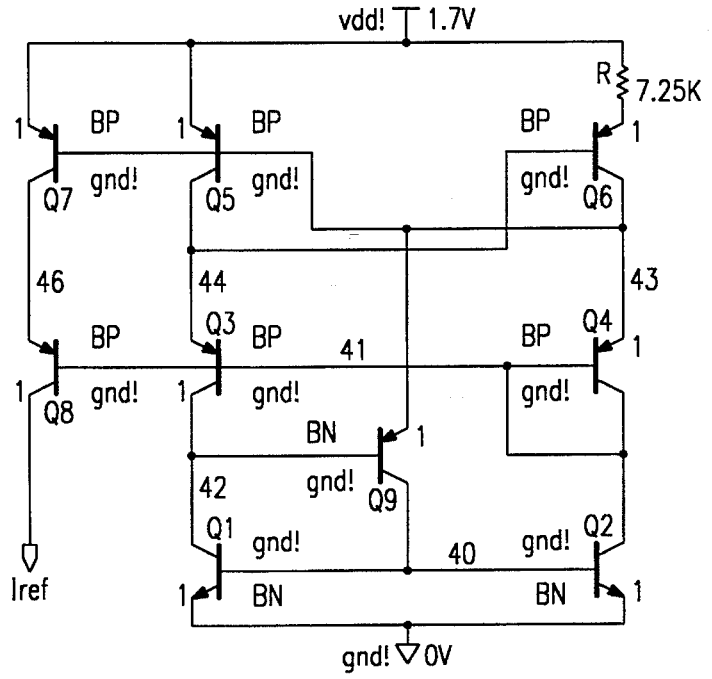
FIGS. 9*a* and 9*b* are circuit diagrams of embodiments of the present invention similar to that of FIG. 2 for sourcing reference current.
Figure 9B:
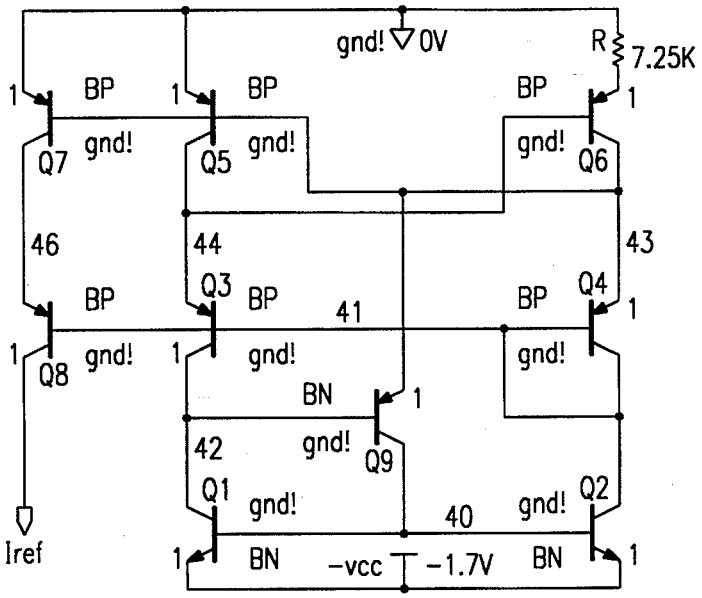

FIGS. 9*a* and 9*b* are circuit diagrams of circuits arranged to act as a current source of a reference current. Like numerals designate like parts as in FIG. 2 and the circuits function in an analagous way and have the same advantages as described above with reference to FIG. 2.

It will be appreciated that the main function of the transistor Q9 is to hold the collector voltage of Q3 independent of the supply voltage. The transistor Q9 could achieve this function with its emitter connected to any of the nodes in the circuit which are set at 1Vbe above ground, particularly node 45 between the output transistors Q7, Q8. The only problems which can arise with other connections of Q9 are those of starting up the circuit but these could be overcome with more start up circuitry.

An additional advantage of the circuit is that the collector of Q4 is likewise held independent of the supply voltage through its connection to the base of Q3. Thus, the "early effect" of both Q3 and Q4 are overcome, rendering the reference current largely independent of supply voltage.

Furthermore, the circuit can function down to a supply voltage level of 2 Vbe+1 Vce, i.e. normally 1.7 V. However, if different transistors are used having lower Vbe, this would be as low as 1.4 V.

Although the explanation given above relates only to bipolar transistors, it will be appreciated that a similar concept would be utilised in a CMOS current generating circuit.

What is claimed is:

1. A circuit for providing a reference current, comprising:

first and second matched transistors, each of said first and second matched transistors having a control node and a controllable path and each of said first and second matched transistors connected so that with a current setting resistor in the controllable path of the second matched transistor, said current setting resistor having a value, current set in said controllable path of said second matched transistor is related to a difference in voltage characteristics between the first and second matched transistors and to the value of the current setting resistor;

third and fourth matched transistors each of said third and fourth matched transistors having a controllable path connected respectively to the controllable paths of the first and second matched transistors, and control electrodes of said third and fourth matched transistors connected together;

a set of output transistors connected to said circuit to supply said reference current in dependence on a set current; and a fifth transistor having a controllable path between a bias node related to a first supply voltage level and a node set at one voltage characteristic relative to a second supply voltage level so as to maintain a voltage across one of the third and fourth matched transistors at a value which is independent of the first supply voltage level to reduce a magnitude of changes in the reference current as a function of the first supply voltage, said fifth transistor having a control electrode connected to said conductive path of said first matched transistor.

2. A circuit as claimed in claim 1 wherein said first matched transistor, said second matched transistor said third matched transistor, said fourth matched transistor said set of output transistors, and said fifth transistor are bipolar transistors and wherein each voltage characteristic of said first matched transistor, said second matched transistor, said third matched transistor, said fourth matched transistor, said set of output transistors, and said fifth transistor is the base-emitter voltage of a transistor.

3. A circuit as claimed in claim 2, wherein said first matched transistor, said second matched transistor, said third matched transistor, said fourth matched transistor, said set of output transistors, and said fifth transistor are n-p-n bipolar transistors and wherein the first supply voltage level is a positive supply voltage Vdd and the second supply voltage level is ground.

4. A circuit as claimed in claim 2, wherein said first matched transistor, said second matched transistor, said third matched transistor, said fourth matched transistor, said set of output transistors, and said fifth transistor are p-n-p bipolar transistors and wherein the first voltage supply level is a negative voltage and the second voltage supply level is ground.

5. A circuit as claimed in claim 2, wherein said first matched transistor, said second matched transistor, said third matched transistor, said fourth matched transistor, said set of output transistors, and said fifth transistor are p-n-p bipolar transistors and wherein the first voltage supply level is ground the second voltage supply level is a positive voltage supply Vdd.

6. A circuit as claimed in claim 3, wherein each of the first and second matched transistors have a base connected to one another and the first matched transistor also having a collector connected to the base of the first matched transistor, said third matched transistor having a collector, said fifth transistor having an emitter and a base, said first matched transistor having an emitter, said second matched transistor having an emitter, wherein the base of the fifth transistor is connected to the collector of the third matched transistor, the emitter of the fifth transistor is connected the bases of the first and second matched transistors, the emitter of the first matched transistor is connected to ground and the emitter of the second matched transistor connected via said resistor to ground.

7. A circuit as claimed in claim 3, wherein said first matched transistor having a base and a collector, said second matched transistor having a base, a collector, and an emitter, said fifth transistor having a base and an emitter, the first matched transistor has a base connected to the collector of the second matched transistor and the base of the second matched transistor is connected to the collector of the first matched transistor, the base of the fifth transistor is connected to the collector of the third matched transistor, the emitter of the fifth transistor is connected to the base of the first matched transistor, the emitter of the first matched transistor is connected to the second voltage supply level and the emitter of the second matched transistor is connected, via the resistor, to the second voltage supply level.

8. A circuit as claimed in any of claim 3 wherein said third matched transistor has a collector and said fourth matched transistor has a collector further comprising a first p-n-p transistor and a second p-n-p transistor, each of said first p-n-p transistor and said second p-n-p transistor having a base, a collector, and an emitter, said base of said first p-n-p transistor and said base of said second p-n-p transistor connected together at said bias node, said emitters of said first p-n-p transistor and said second p-n-p transistor connected to the first supply voltage level and said collector of said first p-n-p transistor connected to the collector of the third matched transistor and said collector of said second p-n-p transistor connected to said collector of said fourth matched transistor.

9. A circuit as claimed in any of claim 2 wherein the fourth matched transistor has a base and a collector, the base of the fourth matched transistor is connected to the collector of the fourth matched transistor.

10. The circuit of claim 3, wherein the fourth matched transistor has a base and a collector, the base of the fourth matched transistor is connected to collector of the fourth matched transistor.

11. The circuit of claim 4, wherein said first matched transistor has a base and a collector, said second matched transistor has a base, an emitter, and a collector, said fifth transistor has a emitter, further wherein the base of the first matched transistor is connected to the collector of the second matched transistor and the base of the second matched transistor is connected to the collector of the first matched transistor, the base of the fifth transistor is connected to the collector of the third matched transistor, the emitter of the fifth transistor is connected to the base of the first matched transistor, the emitter of the first matched transistor is connected to the second voltage supply level and the emitter of the second matched transistor is connected, via the resistor, to the second voltage supply level.

12. The circuit of claim 4, wherein said third matched transistor has a collector and said fourth matched transistor has a collector further comprising a first n-p-n transistor and a second n-p-n transistor, each of said first n-p-n transistor and said second n-p-n transistor having a base, a collector, and an emitter, said base of said first n-p-n transistor and said base of said second n-p-n transistor connected together at said bias node, said emitters of said first n-p-n transistor and said second n-p-n transistor connected to the first supply voltage level and said collector of said first n-p-n transistor connected to the collector of the third matched transistor and said collector of said second n-p-n transistor connected to said collector of said fourth matched transistor.

13. The circuit of claim 4, wherein the fourth matched transistor has a base and a collector, the base of the fourth matched transistor is connected to collector of the fourth matched transistor.

14. The circuit of claim 5, wherein said first matched transistor has a base and a collector, said second matched transistor has a base, an emitter, and a collector, said fifth transistor has a emitter, further wherein the base of the first matched transistor is connected to the collector of the second matched transistor and the base of the second matched transistor is connected to the collector of the first matched transistor, the base of the fifth transistor is connected to the collector of the third matched transistor, the emitter of the fifth transistor is connected to the base of the first matched transistor, the emitter of the first matched transistor is connected to the second voltage supply level and the emitter of the second matched transistor is connected, via the resistor, to the second voltage supply level.

15. The circuit of claim 5, wherein said third matched transistor has a collector and said fourth matched transistor has a collector further comprising a first n-p-n transistor and a second n-p-n transistor, each of said first n-p-n transistor and said second n-p-n transistor having a base, a collector, and an emitter, said base of said first n-p-n transistor and said base of said second n-p-n transistor connected together at said bias node, said emitters of said first n-p-n transistor and said second n-p-n transistor connected to the first supply voltage level and said collector of said first n-p-n transistor connected to the collector of the third matched transistor and said collector of said second n-p-n transistor connected to said collector of said fourth matched transistor.

16. The circuit of claim 5, wherein the fourth matched transistor has a base and a collector, the base of the fourth transistor is connected to collector of the fourth matched transistor.

17. The circuit of claim 6,wherein said third matched transistor has a collector and said fourth matched transistor has a collector further comprising a first p-n-p transistor and a second p-n-p transistor, each of said first p-n-p transistor and said second p-n-p transistor having a base, a collector, and an emitter, said base of said first p-n-p transistor and said base of said second p-n-p transistor connected together at said bias node, said emitters of said first p-n-p transistor and said second p-n-p transistor connected to the first supply voltage level and said collector of said first p-n-p transistor connected to the collector of the third matched transistor and said collector of said second p-n-p transistor connected to said collector of said fourth matched transistor.

18. The circuit of claim 6, wherein the fourth matched transistor has a base and a collector, the base of the fourth matched transistor is connected to collector.

19. The circuit of claim 7, wherein said third matched transistor has a collector and said fourth matched transistor has a collector further comprising a first p-n-p transistor and a second p-n-p transistor, each of said first p-n-p transistor and said second p-n-p transistor having a base, a collector, and an emitter, said base of said first p-n-p transistor and said base of said second p-n-p transistor connected together at said bias node, said emitters of said first p-n-p transistor and said second p-n-p transistor connected to the first supply voltage level and said collector of said first p-n-p transistor connected to the collector of the third matched transistor and said collector of said second p-n-p transistor connected to said collector of said fourth matched transistor.

20. An integrated circuit current generator for operation at low supply voltages from first and second power supply connections, comprising:

first and second branches, each connected between said first and second power supply connections, and an output branch connected between said second power supply connection and a reference current output terminal, each said branch comprising a series combination of transistors;

a current-defining element, connected to provide current between said first branch and said second power supply connection;

a pair of cross-coupled transistors of a first majority carrier conduction type, coupled together in a cross-coupled configuration, and each series-connected into a respective one of said first and second branches;

a pair of mirrored transistors of said first majority carrier conduction type, coupled together in a current mirror configuration, and each series-connected into a respective one of said first and second branches;

a matched pair of bias transistors of a second majority carrier conduction type, having control terminals thereof connected together, and each connected to provide current between said first power supply connection and a respective one of said first and second branches;

an additional transistor of said first majority carrier conduction type, connected to limit the voltage across the one of said mirrored transistors in said second branch;

said output branch including a first output transistor connected to follow at least one of said cross-coupled transistors in a mirrored relationship, in series with a second output transistor connected to follow said mirrored transistors in a mirrored relationship.

21. The circuit of claim 20, wherein said current-defining element is a resistor.

22. The circuit of claim 20, wherein said first and third transistors have respective control terminals thereof cross-coupled.

23. An integrated circuit current generator for operation at low supply voltages from first and second power supply connections, comprising:

a first branch having first and second transistors therein operatively connected, in series with a current-defining element, between said first and second power supply connections;

a second branch having third and fourth transistors therein operatively connected in series between said first and second power supply connections;

said fourth transistor having a control terminal connected in common with a respective control terminal of said second transistor in a current mirror relationship, and said first and third transistors also being mutually interconnected;

a diode connection connected to limit the voltage across said fourth transistor;

an output branch having a first output transistor and a second output transistor therein connected in series between a reference current output terminal and said second power supply connection, said first output transistor having a control terminal connected in common with said control terminal of said third transistor, and said second output transistor having a control terminal connected in common with said control terminal of said fourth transistor.

24. The circuit of claim 23, wherein said current-defining element is a resistor.

25. The circuit of claim 23, wherein said first and third transistors have respective control terminals thereof cross-coupled.

26. An integrated circuit current generator for operation at low supply voltages from first and second power supply connections, comprising:

a first branch having first and second transistors therein operatively connected, in series with a current-defining element, between said first and second power supply connections;

a second branch having third and fourth transistors therein operatively connected in series between said first and second power supply connections;

said fourth transistor having a control terminal connected in common with a respective control terminal of said second transistor in a current mirror relationship, and said first and third transistors also being mutually interconnected;

an additional transistor connected to limit the voltage across said fourth transistor;

an output branch having a first output transistor and a second output transistor therein connected in series between a reference current output terminal and said second power supply connection, said first output transistor having a control terminal connected in common with said control terminal of said third transistor, and said second output transistor having a control terminal connected in common with said control terminal of said fourth transistor.

27. The circuit of claim 26, wherein said current-defining element is a resistor.

28. The circuit of claim 26, wherein said first and third transistors have respective control terminals thereof cross-coupled.

29. An integrated circuit current generator for operation at low supply voltages from first and second power supply connections, comprising:

a first branch having first and second transistors therein operatively connected, in series with a current-defining element, between said first and second power supply connections;

a second branch having third and fourth transistors therein operatively connected in series between said first and second power supply connections;

said fourth transistor having a control terminal connected in common with a respective control terminal of said second transistor in a current mirror relationship;

said first and third transistors being bipolar and being mutually interconnected;

an additional bipolar transistor, having a base-emitter junction thereof connected to shunt the series combination of said fourth transistor with a base-collector junction of said third transistor;

an output branch having a first output transistor and a second output transistor therein connected in series between a reference current output terminal and said second power supply connection, said first output transistor having a control terminal connected in common with said control terminal of said third transistor, and said second output transistor having a control terminal connected in common with said control terminal of said fourth transistor.

30. The circuit of claim 29, wherein said current-defining element is a resistor.

31. The circuit of claim 29, wherein said first and third transistors have respective control terminals thereof cross-coupled.

32. An integrated circuit current generator for operation at low supply voltages from first and second power supply connections, comprising:

a first branch having first and second transistors therein operatively connected, in series with a current-defining element, between said first and second power supply connections;

a second branch having third and fourth transistors therein operatively connected in series between said first and second power supply connections;

said fourth transistor having a control terminal connected in common with a respective control terminal of said second transistor in a current mirror relationship, and said first and third transistors also being mutually interconnected; said first, second, third, and fourth transistors all having a first majority carrier conduction type; and further comprising first and second bias transistors, of a second majority carrier conduction type, connected to provide currents from said first power supply connection to said first and second branches respectively;

an additional transistor of said first majority carrier conduction type, connected to draw current from control terminals of said bias transistors, and connected to limit the voltage across said fourth transistor;

an output branch having a first output transistor and a second output transistor therein connected in series between a reference current output terminal and said second power supply connection, said first output transistor having a control terminal connected in common with said control terminal of said third transistor, and said second output transistor having a control terminal connected in common with said control terminal of said fourth transistor.

33. The circuit of claim 32, wherein said current-defining element is a resistor.

34. The circuit of claim 32, wherein said first and third transistors have respective control terminals thereof cross-coupled.

* * * * *

UNITED STATES PATENT AND TRADEMARK OFFICE

CERTIFICATE OF CORRECTION

PATENT NO. : 5,517,103

DATED : May 14, 1996

INVENTOR(S) : Solomon K. Ng and Gee H. Loh

It is certified that error appears in the above-identified patent and that said Letters Patent is hereby corrected as shown below:

On title page, item (73) should read as follows:

Assignee: SGS-Thomson Microelectronics PTE Ltd.

Signed and Sealed this

Ninth Day of June, 1998

*Attest:*

Bruce Lehman

BRUCE LEHMAN

*Attesting Officer*

*Commissioner of Patents and Trademarks*